US005716270A

United States Patent [19]

Chambers

[11] Patent Number: 5,716,270

[45] Date of Patent: Feb. 10, 1998

[54] FRICTIONALLY MOUNTED LOUVERED DIFFUSER

[76] Inventor: Charles F. Chambers, 3121 Via Lopez, Memphis, Tenn. 38133

[21] Appl. No.: 732,666

[22] Filed: Oct. 16, 1996

[51] Int. Cl.[6] ..... F24F 13/075

[52] U.S. Cl. ..... 454/332; 454/309

[58] Field of Search ..... 424/284, 289, 424/290, 309, 322, 325, 330, 331, 332

[56] References Cited

U.S. PATENT DOCUMENTS

| | | | |
|---|---|---|---|
| 549,300 | 11/1895 | Walter . | |
| 723,433 | 3/1903 | Arend | 454/332 |
| 1,347,139 | 7/1920 | Adams . | |
| 2,722,170 | 11/1955 | Broberg | 454/332 |
| 2,806,726 | 9/1957 | Broberg . | |
| 3,165,999 | 1/1965 | Noll | 454/322 X |
| 3,366,031 | 1/1968 | Hedrick et al. . | |
| 3,715,971 | 2/1973 | Moyer | 454/330 |
| 3,955,483 | 5/1976 | Sunter . | |

FOREIGN PATENT DOCUMENTS

| | | | |
|---|---|---|---|
| 54 | 1/1931 | Australia | 454/309 |
| 1167245 | 11/1958 | France | 454/330 |
| 1 168 043 | 4/1964 | Germany | 454/330 |

*Primary Examiner*—Harold Joyce
*Attorney, Agent, or Firm*—Terrance L. Siemens

[57] ABSTRACT

A louvered air diffuser which mounts to an outlet of an air distribution system of a building and is removed therefrom without tools. The diffuser has two arms which expand resiliently to engage an environmental surface of the air conduit of the distribution system. The arms each have teeth for improving frictional engagement of the environmental surface. The arms and teeth are configured to assure that the arms are urged inwardly, away from frictional engagement of the environmental element, when being installed and removed. Optionally, the teeth have holes with sharp edges, or holes for receiving rubber projections for enhancing grip.

16 Claims, 2 Drawing Sheets

FRICTIONALLY MOUNTED LOUVERED DIFFUSER

BACKGROUND OF THE INVENTION

1. Field of the Invention

The present invention relates to louvered air diffuser intended for tool free mounting in an opening in a wall or partition of a building. The diffuser includes conventional panels, a face plate, and resilient arms which resisiently and frictionally engage the opening.

2. Description of the Prior Art

Heating, air conditioning, and ventilation systems of buildings typically discharge forced air into selected areas of a building through diffusers. A diffuser both directs discharged air and presents a finished or semifinished appearance to the opening of a duct or passageway conducting air to the site of discharge.

Although it may seem a minor matter to the layman, securing a diffuser in place entails effort by the mechanic to assure both performance and also aesthetic orientation of the diffuser relative to its wall or partition. The diffuser must be adequately secured to the wall so as to seal the opening. The diffuser must not vibrate. From an aesthetic perspective, the diffuser, which typically has a rectangular face plate, must be set with its face plate flush against the finished wall or partition.

Many air conduits terminate in structures not precisely matching retaining structure of the diffuser. For example, plasterboard walls may have rectangular openings cut therein by hand. It would be desirable to provide a diffuser having apparatus for adjustably engaging a rough cut opening in drywall.

To assure solid and appropriately close fit, the prior art has proposed frictional engagement by resilient arms. In U.S. Pat. Nos. 549,300, issued to Samuel Walter on Nov. 5, 1895, and 723,433, issued to Edward H. Arend on Mar. 24, 1903, we see inwardly projecting, resilient arms terminating in outwardly projecting tabs. However, the angle formed between these tabs and the principal portion of their respective arms could tend to bind on the inner surface of a sheet of drywall when someone attempts to withdraw the associated device. By contrast, the present invention provides instead teeth, or projections having more gently sloped projections, for enabling ready detent during withdrawal. Also, the present invention exposes surfaces offering improved frictional engagement of an environmental surface. These surfaces may constitute minute sharp edges having attendant abilities to engage a surface, should the opening occur in a masonry or concrete wall or the like. Alternatively, these surfaces may comprise rubber or similar projections.

U.S. Pat. No. 1,347,139, issued to William C. Adams on Jul. 20, 1920, shows resilent arms having tabs lacking the severe angles of Walter and Arend. However, these tabs are inwardly turned and lack teeth, both characteristics differing from the present invention.

Rubber projections are shown in U.S. Pat. No. 3,955,483, issued to Raymond B. Sunter on May 11, 1976. However, in the Sunter device, there is no resilient arm disposed generally parallel to the air conduit, as occurs in the present invention. Rather, these rubber projections are located on a laterally expanding arm which requires a solid surface for successful anchorage. This arrangement could possibly not be suitable for sheet metal ductwork, nor to mount its associated grille to a plenum chamber lacking requisite solid lateral surfaces behind drywall or any similar facade.

None of the above inventions and patents, taken either singly or in combination, is seen to describe the instant invention as claimed.

SUMMARY OF THE INVENTION

The present invention enables manual anchorage of a diffuser within a wall opening, and manual removal thereof. Tools, driven fasteners such as screws, and permanently mounted complementing members are eliminated. At the same time, the invention is particularly effective in enabling removal of the diffuser because the engaging structure is carefully configured to avoid binding and similar sticking when contacting a concealed or blind interior surface of a wall, ductwork, or the like as the novel diffuser is withdrawn.

To these ends, the novel diffuser includes conventional structure such as a face plate, louvers, and the like. The novel diffuser is secured in place by two arms projecting into the air conduit from the rear of the face plate. These arms incline outwardly, towards the walls of the air conduit, to a slight degree, and are resilient. Each arm has an inwardly inclined tab for guiding its respective arm past obstructions due to environmental elements.

At or proximate the outwardmost end of the arms, and prior to the point at which the tabs project from the arms, one or two teeth are formed. These teeth avoid having any surface which is perpendicular to the direction or axis of installation and removal, and have no overbent tab. Either of these two characteristics could cause binding or interference which could not be overcome when pulling the diffuser out from its mounting. These teeth are configured to include outer surfaces disposed only at oblique angles to a plane perpendicular to the direction of installation and removal of the air diffuser, or parallel to the face plate.

Thus, the novel air diffuser has resilient arms for engaging an environmental element and, equally importantly, structure for urging each arm inwardly when the air diffuser is installed and removed. This characteristic enables the arms to negotiate projections and obstructions of the environment of the air conduit successfully. A consequence of this construction is that both installation and removal may be performed manually, merely by pushing the air diffuser into place and pulling it therefrom.

Optionally, these teeth may have further enhancements to their outward frictional grip. In one embodiment, sharp edged holes may be introduced into the teeth. In another embodiment, holes may be introduced into the teeth for receiving rubber grommets or similar projections. In both cases, interference is avoided either by appropriate inclination of the teeth and its associated components, or by resilient deflection of projections, if formed from flexible rubber or a similar composition.

These arms and teeth engage any environmental element of the site of the installation of the diffuser, such as drywall, wood, concrete or masonry air conduit walls, flanges formed in air ducts, air supply duct boots, and the like. After all, it must be recognized that air passages may be formed by sheet metal duct, prefabricated plastic tubing, or by openings and voids formed by walls, chases, and similar architectural features of a building served by an air distribution system.

The novel diffuser may thus be required to contact and mount only on a wall or partition, such as a drywall panel having an opening cut thereinto. In other examples, the diffuser contacts both a finished or unfinished wall or partition, but also frictionally engages ductwork. In still other examples, the diffuser must frictionally engage a brick or other masonry passageway. The novel structure providing resilient arms frictionally engaging an environmental surface is quite versatile in its ability to work with many different environmental surfaces.

Accordingly, it is a principal object of the invention to provide a diffuser which is suitable for manual or tool free installation in and removal from an opening in a wall or partition.

It is another object of the invention to avoid interference with a blind interior surface of a wall or other environmental element.

It is a further object of the invention to provide resilient members impinging upon and frictionally engaging an environmental element of the wall or air conduit.

Still another object of the invention is to provide teeth on the resilient members.

It is again an object of the invention to form a hole in each tooth of the resilient members.

Yet another object of the invention is to enhance frictional grip of the teeth upon environmental elements and surfaces of the wall or air conduit.

An additional object of the invention is to provide rubber tips on teeth of the resilient members.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figures 1, 2:
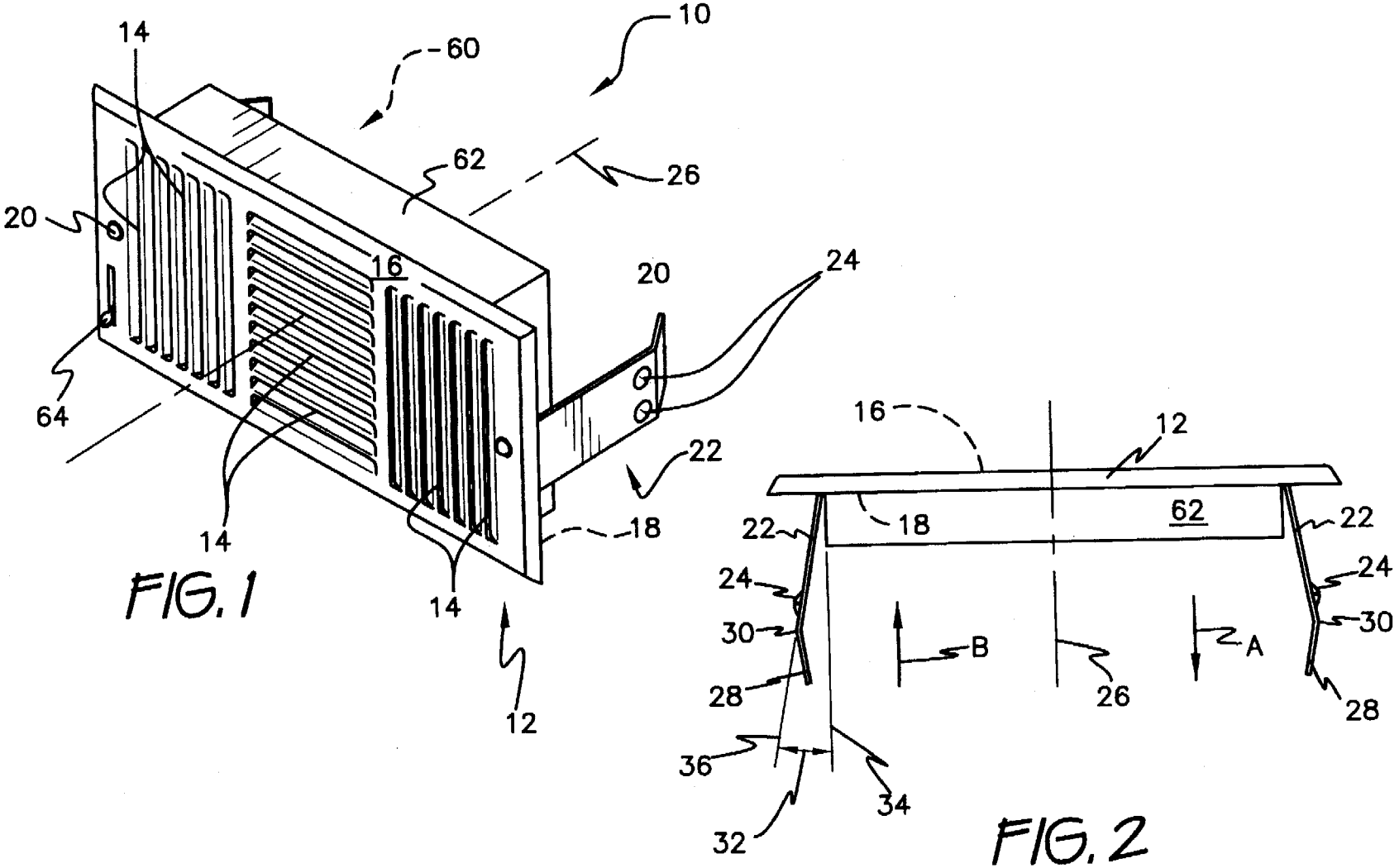
FIG. 1 is a perspective view of the invention.
FIG. 2 is a top plan view of the invention.

Turning now to FIG. 1 of the drawings, novel air diffuser 10 is seen to comprise face plate 12 having a grille or openings 14 for passage of air. Throughout the following description, that surface of face plate 12 exposed to a room or space (neither shown) receiving air discharged from the associated air distribution system (not shown) will be referred to as front surface 16. The opposing surface of face plate 12, that being the surface exposed to ducts (not shown) and other elements of the air distribution system, will be referred to as rear surface 18.

Diffuser 10 is mounted over an opening formed in a wall or partition (neither shown) of a building, the opening enabling passage of air from a forced air distribution system of the building. To this end, overall dimensions of face plate 12 will be greater than those of the opening, so that face plate 12 serves the further function of providing a finished appearance to the opening.

Prior art diffusers (not shown) generally attach to the wall or partition over the opening by screws. To accommodate conventional attachment as an option for versatility of mounting, screw holes 20 are formed in face plate 12. To enable manual, tool free mounting, two arms 22 are provided for engaging environmental surfaces of elements of the air distribution system and securing air diffuser 10 thereto. Although FIG. 1 actually shows one arm 22, it will be understood that there is a similar, mirror image arm 22 disposed on an opposed side of face plate 12. For balanced, secure attachment, both screw holes 20 and arms 22 are diametrically opposed on opposite sides of face plate 12, although this characteristic could be modified if desired.

Arms 22 project from rear surface 22 towards the air distribution system, when diffuser 10 is installed over its associated opening. Each arm 22 has a proximal end attached in any suitable way to face plate 12. Examples of attachment are by press fit, riveting, tack welding, and adhesive, although still other methods may be employed.

Arms 22 are clearly seen in FIG. 2. Each arm 22 has at least one, and preferably two, teeth 24 projecting outwardly from its associated arm 22 at the distal end of its associated arm 22. Each tooth 24 projects from arm 22 between the proximal end of arm 22 and the distal end of arm 22, but in close proximity to the distal end. Each tooth 24 contacts its associated arm 22 along the entire periphery of the base of tooth 24, where the base may be said to comprise that portion of each tooth 24 where tooth 24 projects from the generally planar arm 22. Outwardly will be understood to be relative to an air flow axis 26 which is preferably perpendicular to face plate 12. Arms 22 are formed from a resilient, semirigid material, such as spring steel. Spring steel is resilient and elastic, so that it will attempt to move back to its original position if displaced by deflection as arm 22 passes an obstruction. At the same time, it is semirigid in that while it enables such deflection, it stands erect in its original position projecting from face plate 12.

Each arm 22 includes a tab 28 fixed to the distal end of its associated arm 22. Tab 28 turns inwardly, again referring to axis 26 commencing at a joint 30 defining a transition between an arm 22 and its respective tab 28. Tab 28 projects, or is directed, away from face plate 12 as it diverges from its respective arm 22. This arrangement provides a guide urging an arm 22 inwardly when tab 28 encounters a solid obstruction (not shown) which may be present behind the wall or partition over which diffuser 10 is being installed.

Tab 28 is sufficiently long to terminate at a point inside its associated arm 22. Therefore, even an obstruction penetrating well into an air conduit of the air distribution system will deflect arm 22 when diffuser 10 contacts the obstruction as diffuser 10 is moved in the direction of arrow A when being installed.

FIG. 2 further reveals that arms 22 preferably incline outwardly from face plate 12, as indicated by angle 32 disposed between a projection line 34 which is parallel to axis 26, and a projection line 36 coaxial with and extending beyond arm 22. The significance of this inclination is that when tooth 24 passes and engages an obstruction, arm will exert a mild force urging face plate 12 against its contacting environmental element, such as the wall or partition, when face plate 12 is installed over and abuts its vertical environmental mounting surface.

Figure 3:
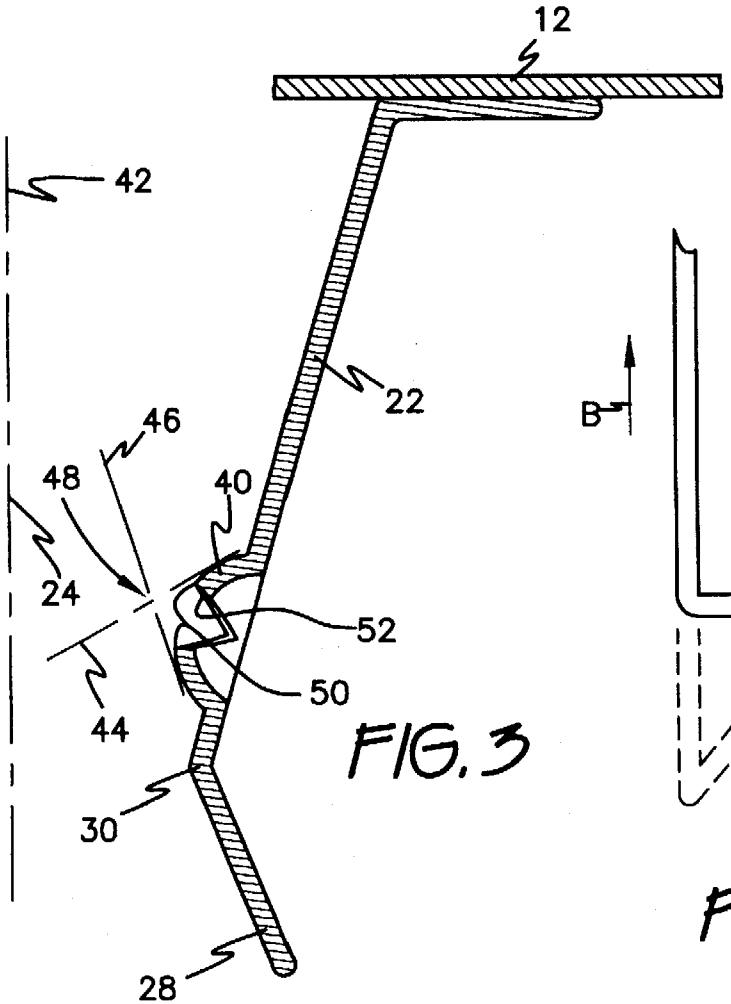
FIG. 3 is an enlarged cross sectional detail view of an arm seen at the left of FIG. 2.

Turning now to FIG. 3, properties of tooth 24 will be set forth in greater detail. Each tooth 24 is configured to have an outer surface 40 disposed only at oblique angles to a plane 42 parallel to face plate 12. This relationship signifies that straight lines (exemplified at 44 and 46) which are tangent to surface 40 at all points except for an outermost point 48 disposed at the maximum height of tooth 24 are disposed an a non-parallel, non-perpendicular angle to plane 42. This property assures that associated arm 22 is urged inwardly and disengages from an environmental element obstructing and contacted by tooth 24 when diffuser 10 is installed and removed.

Each tooth 24 has a sharp edge 50 generally located at outermost point 48, created by splitting tooth 24 or introducing a hole 52 therein. This edge 50 improves frictional engagement of an irregular environmental surface, such as masonry, concrete, or wood, in a manner improved over that which would prevail if tooth 24 had a rounded end (not shown) in the absence of hole 52 or edge 50. This feature is utilized where the air conduit of the air distribution system is formed by a passageway defined between structural walls and partitions, rather than by sheet metal ductwork.

Figure 4:
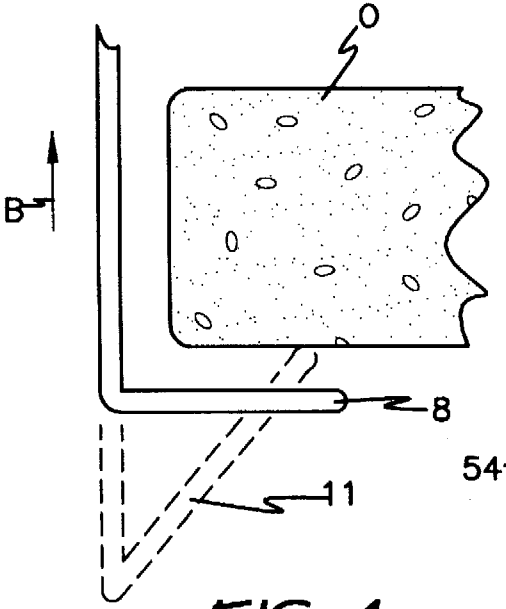
FIG. 4 PRIOR ART
FIG. 4 is an enlarged top plan detail view illustrating potential interference which may occur in the prior art and which is overcome by the present invention.

The advantage of the described configuration of tooth 24 is pointed up by comparison with FIG. 4, which illustrates situations which could ensue given the structure of prior art arms and tabs of Arend and Walter. Lateral projection of tab 8 of Walter could interfere with or catch on obstruction O, when being removed. Removal is indicated by arrow B. Similarly, the overbent tab 11 of Arend, shown in broken lines in FIG. 4, will also exhibit a tendency to interfere or catch. By contrast, and returning to FIG. 3, oblique angles of tooth 4 will avoid direct interference, instead urging tooth 24 and associated arm 22 inwardly, thus clearing any similar obstruction.

Figure 5:
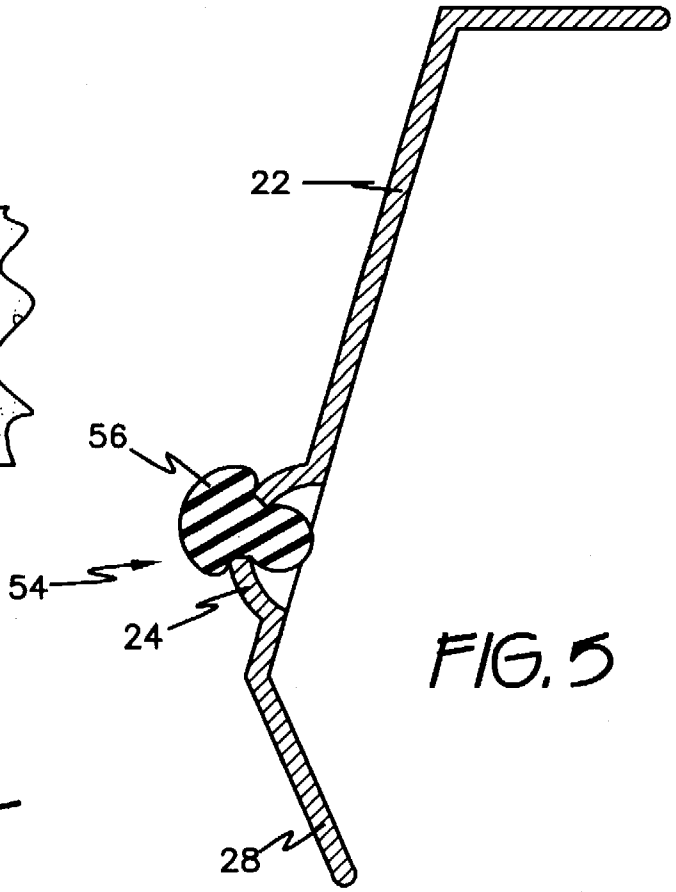
FIG. 5 is an enlarged cross sectional detail view of an alternative embodiment of the arm shown at the left of FIG. 2.

For those instances in which diffuser 10 engages the boot of an air supply duct (not shown), the hole 52 of the embodiment of FIG. 3 is modified to avoid sharp edge 50. Rather, and referring now to FIG. 5, hole 54 has rounded edges for accommodating a rubber plug or projection 56. Projection 56 is disposed at the outermost point of hole 54, and will come to contact a surface of the boot. It is contemplated that a deformable, elastic object such as projection 56 will improve frictional engagement of the smooth surface of sheet metal over that afforded by sharp edge 50 (see FIG. 3).

The present invention is susceptible to variations and modifications which may be introduced by those of skill in the art. For example, in the preferred embodiment of FIG. 1, diffuser 10 includes movable louvers 60 enclosed in a casing 62 attached to the rear of face plate 12 and operated by a lever 64 penetrating forwardly through face plate 12. In other embodiments, louvers 60 and associated elements are omitted, and only face plate 12 is provided.

It is to be understood that the present invention is not limited to the embodiments described above, but encompasses any and all embodiments within the scope of the following claims.

I claim:

1. An air diffuser suitable for manual, toolless mounting over an opening of an air distribution system of a building, comprising:

a face plate having openings for passage of air, said face plate having a front surface exposed to space receiving air discharged from the air distribution system and a rear surface exposed to the air distribution system; and two arms for engaging environmental surfaces of elements of the air distribution system and securing said air diffuser thereto, said arms projecting from said rear surface of said face plate, said two arms disposed on opposite sides of said face plate, said two arms formed from a resilient, semirigid material, each said arm having a proximal end attached to said face plate, a distal end, and at least one tooth projecting outwardly from said arm at said distal end of said arm, each said tooth having an outer surface disposed only at oblique angles to a plane parallel to said face plate, each said tooth projecting from said arm between said proximal end of said arm and said distal end of said arm, said tooth contacting said arm along the entire periphery of the base of said tooth, whereby said arm is urged inwardly and disengages from the environmental element when said air diffuser is removed.

2. The air diffuser according to claim 1, each said arm further comprising a tab fixed thereto at said distal end thereof, there being a joint between said distal end of said arm and said tab, said tab turning inwardly from said joint and projecting away from said face plate, whereby said arm is urged inwardly when said tab encounters a solid obstruction when said air diffuser is installed.

3. The air diffuser according to claim 2, each said tab being of sufficient length to terminate at a point inside its associated said arm, whereby an obstruction penetrating well into an air conduit of the air distribution system will deflect said arm when said air diffuser is being installed.

4. The air diffuser according to claim 1, said two arms inclining outwardly from said face plate, whereby each said arm exerts a force urging said face plate against a contacting environmental element when said face plate is installed over and abuts a vertical environmental surface.

5. The air diffuser according to claim 1, each said tooth having an outermost point and a sharp edge located at said outermost point, whereby frictional engagement of an irregular environmental surface by said tooth is improved.

6. The air diffuser according to claim 1, each said tooth having an outermost point and a rubber projection located at said outermost point, whereby frictional engagement of a smooth environmental surface by said tooth is improved.

7. The air diffuser according to claim 1, further including at least two screw holes formed in said face plate on diametrically opposed sides thereof.

8. The air diffuser according to claim 1, further including movable louvers, a casing enclosing said louvers, said casing attached to said rear surface of said face plate, and a lever for operating said movable louvers.

9. An air diffuser suitable for manual, toolfree mounting over an opening of an air distribution system of a building, comprising:

a face plate having openings for passage of air, said face plate having a front surface exposed to space receiving air discharged from the air distribution system and a rear surface exposed to the air distribution system; and two arms for engaging environmental surfaces of elements of the air distribution system and securing said air diffuser thereto, said arms projecting from said rear surface of said face plate, said two arms inclining outwardly from said face plate, whereby each said arm exerts a force urging said face plate against a contacting environmental element when said face plate is installed over and abuts a vertical environmental surface, said two arms disposed on opposite sides of said face plate, said two arms formed from a resilient, semirigid material, each said arm having a proximal end attached to said face plate, a distal end, and at least one tooth projecting outwardly from said arm at said distal end of said arm, each said tooth having an outer surface disposed only at oblique angles to a plane parallel to said face plate, whereby said arm is urged inwardly and disengages from the environmental element when said air diffuser is removed, each said arm further comprising a tab fixed thereto at said distal end thereof, there being a joint between said distal end of said arm and said tab, said tab turning inwardly from said joint and projecting away from said face plate, whereby said arm is urged inwardly when said tab encounters a solid obstruction when said air diffuser is installed, each said tab being of sufficient length to terminate at a point inside its associated said arm, whereby an obstruction penetrating well into an air conduit of the air distribution system will deflect said arm when said air diffuser is being installed.

10. The air diffuser according to claim 9, each said tooth having an outermost point and a sharp edge located at said outermost point, whereby frictional engagement of an irregular environmental surface by said tooth is improved.

11. The air diffuser according to claim 9, each said tooth having an outermost point and a rubber projection located at said outermost point, whereby frictional engagement of a smooth environmental surface by said tooth is improved.

12. The air diffuser according to claim 9, further including at least two screw holes formed in said face plate on diametrically opposed sides thereof.

13. The air diffuser according to claim 9, further including movable louvers, a casing enclosing said louvers, said casing attached to said rear surface of said face plate, and a lever for operating said movable louvers.

14. An air diffuser suitable for manual, tool free mounting over an opening of an air distribution system of a building, comprising:

a face plate having openings for passage of air, said face plate having a front surface exposed to space receiving air discharged from the air distribution system and a rear surface exposed to the air distribution system, said face plate having at least two screw holes formed therein;

movable louvers, a casing enclosing said louvers, said casing attached to said rear surface of said face plate, and a lever for operating said movable louvers; and two arms for engaging environmental surfaces of elements of the air distribution system and securing said air diffuser thereto, said arms projecting from said rear surface of said face plate, said two arms inclining outwardly from said face plate, whereby each said arm exerts a force urging said face plate against a contacting environmental element when said face plate is installed over and abuts a vertical environmental surface, said two arms disposed on opposite sides of said face plate, said two arms formed from a resilient, semirigid material, each said arm having a proximal end attached to said face plate, a distal end, and at least one tooth projecting outwardly from said arm at said distal end of said arm, each said tooth having an outer surface disposed only at oblique angles to a plane parallel to said face plate, whereby said arm is urged inwardly and disengages from the environmental element when said air diffuser is removed, each said arm further comprising a tab fixed thereto at said distal end thereof, there being a joint between said distal end of said arm and said tab, said tab turning inwardly from said joint and projecting away from said face plate, whereby said arm is urged inwardly when said tab encounters a solid obstruction when said air diffuser is installed, each said tab being of sufficient length to terminate at a point inside its associated said arm, whereby an obstruction penetrating well into an air conduit of the air distribution system will deflect said arm when said air diffuser is being installed.

15. The air diffuser according to claim 14, each said tooth having an outermost point and a sharp edge located at said outermost point, whereby frictional engagement of an irregular environmental surface by said tooth is improved.

16. The air diffuser according to claim 14, each said tooth having an outermost point and a rubber projection located at said outermost point, whereby frictional engagement of a smooth environmental surface by said tooth is improved.

* * * * *